US007899358B2

(12) United States Patent
Ishikawa

(10) Patent No.: US 7,899,358 B2
(45) Date of Patent: Mar. 1, 2011

(54) DEVELOPING CARTRIDGE, PROCESS CARTRIDGE, AND IMAGE FORMING APPARATUS

(75) Inventor: Satoru Ishikawa, Kitanagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 243 days.

(21) Appl. No.: 11/519,095

(22) Filed: Sep. 12, 2006

(65) Prior Publication Data

US 2007/0071480 A1 Mar. 29, 2007

(30) Foreign Application Priority Data

Sep. 14, 2005 (JP) ..... 2005-266586
Aug. 31, 2006 (JP) ..... 2006-235097

(51) Int. Cl.
*G03G 21/18* (2006.01)

(52) U.S. Cl. ..... 399/111; 399/90; 399/113

(58) Field of Classification Search ..... 399/90, 399/111, 113, 119, 240, 241, 285
See application file for complete search history.

(56) References Cited

U.S. PATENT DOCUMENTS

| | | | | |
|---|---|---|---|---|
| 6,029,027 | A * | 2/2000 | Yokomori et al. | 399/90 |
| 6,101,350 | A | 8/2000 | Suzuki et al. | |
| 6,137,970 | A * | 10/2000 | Sasago | 399/106 |
| 6,519,430 | B2 * | 2/2003 | Higeta et al. | 399/109 |
| 2004/0028424 | A1 * | 2/2004 | Yokoi | 399/90 |
| 2005/0047824 | A1 * | 3/2005 | Kawai | 399/119 |
| 2005/0201772 | A1 | 9/2005 | Ishii et al. | |

FOREIGN PATENT DOCUMENTS

| | | | |
|---|---|---|---|
| JP | 62226164 | A * | 10/1987 |
| JP | 2000-250310 | | 9/2000 |
| JP | 2005-258344 | | 9/2005 |

* cited by examiner

*Primary Examiner* — David M Gray
*Assistant Examiner* — Andrew V Do
(74) *Attorney, Agent, or Firm* — Banner & Witcoff, Ltd.

(57) ABSTRACT

A developing cartridge is attachable to and detachable from an image forming apparatus and is received by a developing cartridge receiving member. The developing cartridge includes: a developer carrier including a rotational shaft; a case that rotatably supports the developer carrier, the case being capable of being supported by the developing cartridge receiving member; and a conductive member electrically connected to the rotational shaft of the developer carrier, at least a part of the conductive member is positioned at an opposite side of the case to the developing cartridge receiving member in a substantially vertical direction.

17 Claims, 9 Drawing Sheets

DEVELOPING CARTRIDGE, PROCESS CARTRIDGE, AND IMAGE FORMING APPARATUS

CROSS REFERENCE TO RELATED APPLICATION

This application claims priority from Japanese Patent Applications No. 2005-266586, filed on Sep. 14, 2005, and No. 2006-235097, filed on Aug. 31, 2006, the entire subject matters of which are incorporated herein by reference.

TECHNICAL FIELD

Aspects of the present invention relate to a developing cartridge, a process cartridge, and an image forming apparatus.

BACKGROUND

In a photosensitive member cartridge on which a developing cartridge is mounted, as disclosed in JP-A-2000-250310, a plurality of rotatable rollers are disposed in a developing cartridge accommodating portion. When the developing cartridge is attached in the developing cartridge accommodating portion, the weight of the developing cartridge is received on an opposite side of a roller shaft of a developing roller to a photosensitive drum by the rollers. Further, with the rollers, rattling is suppressed which otherwise occurs when attaching and detaching the developing cartridge.

SUMMARY

If a power-supply terminal of the image forming apparatus is brought into contact with a conductive bearing member, which rotatably supports the developing roller shaft and applies a developing bias to the developing roller shaft, from below, pressing of the developing roller against the photosensitive drum becomes instable, and quality of a resultant image is degraded.

Aspects of the invention provide a developing cartridge that, even though a main body-side power-supply electrode of an image forming apparatus presses a conductive member in order to apply a developing bias, can obtain a good-quality image, without causing pressing of a developing roller against a photosensitive drum to be instable, a process cartridge, and an image forming apparatus.

DETAILED DESCRIPTION

General Overview

According to an aspect of the invention, there is provided a developing cartridge, which is attachable to and detachable from an image forming apparatus and is received by a developing cartridge receiving member, the developing cartridge including: a developer carrier including a rotational shaft; a case that rotatably supports the developer carrier, the case being capable of being supported by the developing cartridge receiving member; and a conductive member electrically connected to the rotational shaft of the developer carrier, at least a part of the conductive member is positioned at an opposite side of the case to the developing cartridge receiving member in a substantially vertical direction.

According to the aspect of the invention, when the developing cartridge is mounted on the image forming apparatus, the main body-side power-supply electrode is brought into contact with the conductive member on the vertical line of the developing cartridge receiving member from the side opposite to the developing cartridge receiving member. Accordingly, the weight of the developing cartridge is received by the developing cartridge receiving member, and thus a force that causes rattling of the developing cartridge stably accommodated is not applied. Therefore, the contact state of the electrostatic latent image carrier and the developer carrier can be prevented from being instabilized, and thus good image quality can be secured.

(1) Overview of Entire Image Forming Apparatus

Figure 1:
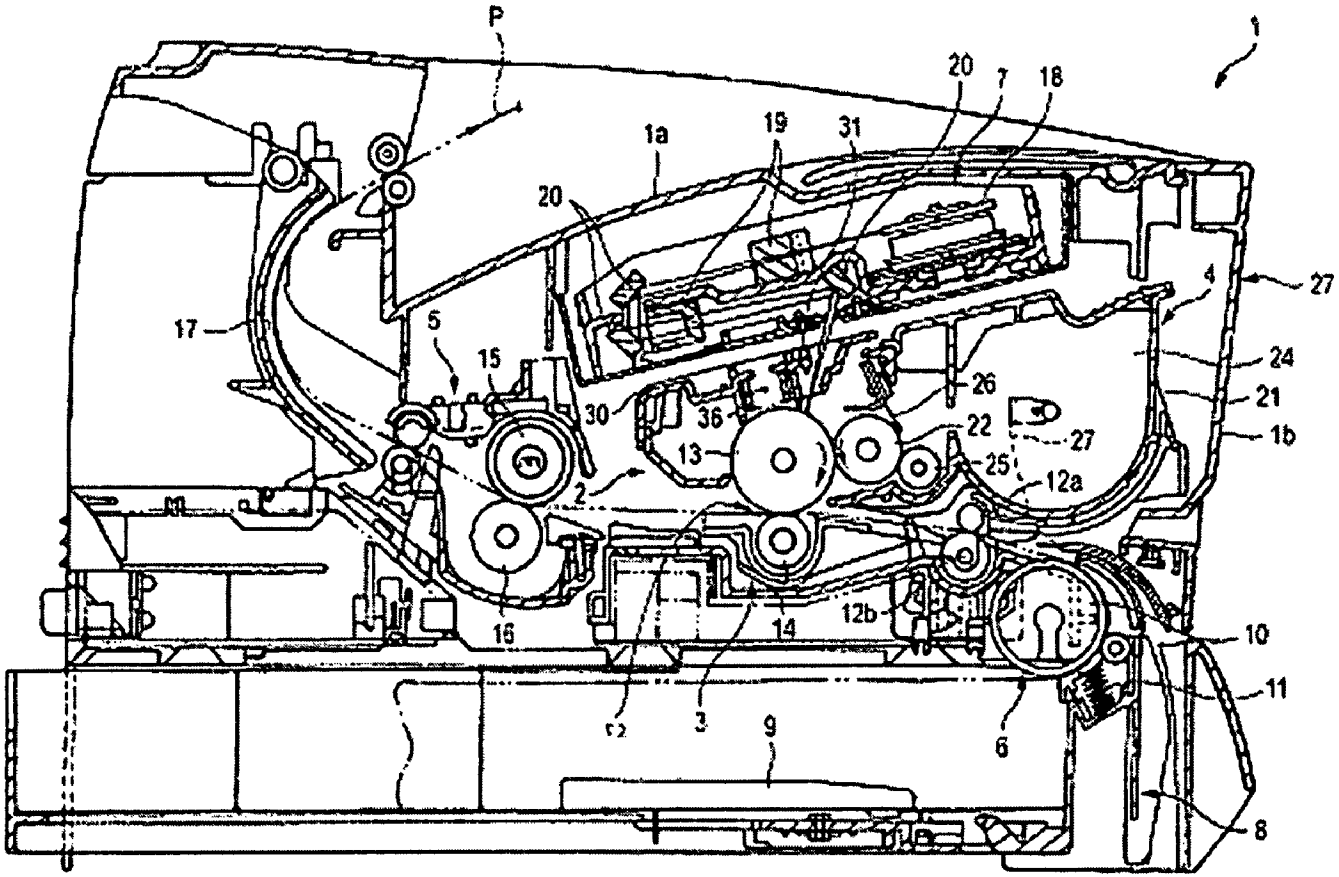
FIG. 1 is a schematic side sectional view of a printer as an image forming apparatus.

Next, an aspect of the invention as a laser printer will be described. FIG. 1 is a schematic side sectional view of a printer as an image forming apparatus.

As shown in FIG. 1, in a main body housing 1 of the printer, a process cartridge 2 having a photosensitive member cartridge 3 and a developing cartridge 4 is detachably disposed at an approximately central portion. As shown in a left portion of FIG. 1, a fixing device 5 is disposed close to the process cartridge 2, and a sheet feeder 6 is disposed below the process cartridge 2. A sheet feed cassette 8 can be mounted from a front surface (an arrow A) direction at a lower portion of the main body housing 1.

A laser scanner unit 7 is attached to a lower surface of a sheet discharge tray 1*a* formed of synthetic resin through a frame. The sheet discharge tray 1*a* also serves as a cover.

When print data is transmitted from an external apparatus (not shown), for example, a personal computer, upon a print instruction, a sheet P is separated from a stack of sheets P on a support plate 9 of the sheet feed cassette 8 by a separator pad 11 one by one according to rotation of a sheet feed roller 10 of the sheet feeder 6. The separated sheet P is conveyed to a contact portion between a photosensitive drum 13 serving as an electrostatic latent image carrier in the process cartridge 2 and a transfer roller 14 pressed against a lower surface of the photosensitive drum 13 through a pair of register rollers 12*a* and 12*b*. A laser beam is emitted from the laser scanner unit 7 having a laser light-emitting portion, a polygon mirror 18, a lens 19, a plurality of reflecting mirrors 20, and the like, through a light-emitting hole formed in a lower portion of the frame supporting the laser scanner unit 7. The laser beam travels to an upper peripheral surface portion of the photosensitive drum 13 through a light entrance portion 31 formed in a case 30 serving as the housing of the photosensitive member cartridge 3, that is, a case in the process cartridge 2.

The peripheral surface of the photosensitive drum 13 is exposed corresponding to the print data, such that an electrostatic latent image is formed.

As described below, a developer (toner) supplied from a developing roller 22 serving as a developer carrier in the developing cartridge 4 is disposed on the electrostatic latent image, thereby making an image visible. After the visible image by developer (toner) on the photosensitive drum 13 is transferred to the sheet 2, the sheet P is conveyed between a heat roller 15 and a presser roller 16 in the fixing device 5, in which the sheet P is subjected to a heat-fixing process. The sheet P is then discharged onto the sheet discharge tray la through a sheet discharge passage 17.

In this aspect, the process cartridge 2 includes the photosensitive member cartridge 3 having the photosensitive drum 13 and a developing cartridge receiving member to be described below and the developing cartridge 4 having a developing roller 22 that is rotatably disposed in a case 21 serving as the housing. The developing cartridge 4 is formed to be attachable to and detachable from the photosensitive member cartridge 3. Then, the developing cartridge 4 and the photosensitive member cartridge 3 are detachably mounted on a printer main body together or separately.

Next, the configuration of the photosensitive member cartridge 3 and the developing cartridge 4 will be described in detail.

(2) Configuration of Photosensitive Member Cartridge

Figure 2:
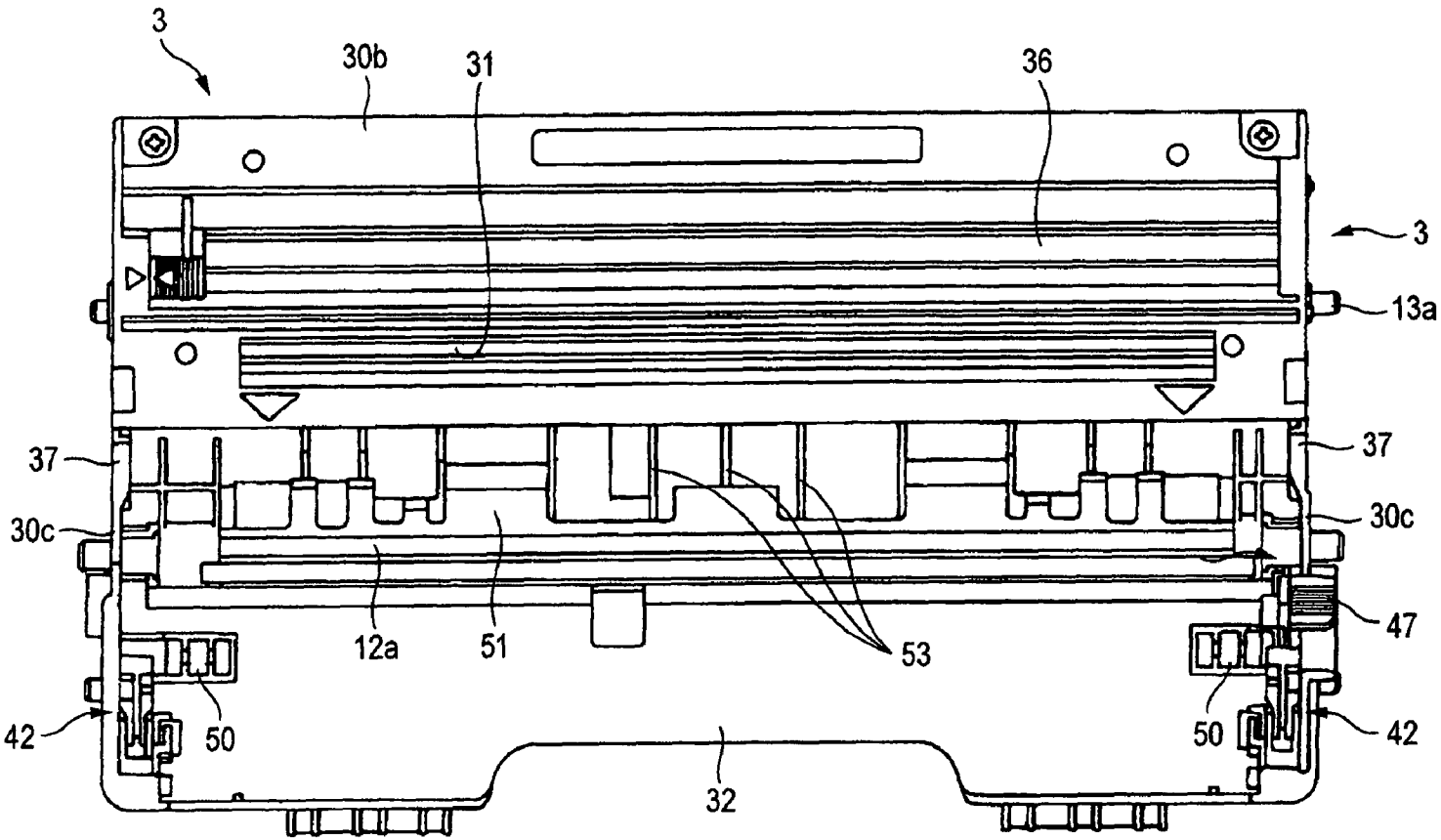
FIG. 2 is a plan view of a photosensitive member cartridge.

FIG. 2 is a plan view of the photosensitive member cartridge. In the photosensitive member cartridge 3, the photosensitive drum 13 is rotatably journaled in the case 30 formed of synthetic resin near one side thereof. A lower portion of the transfer roller 14 serving as a transfer device disposed below the photosensitive drum 13 is covered with a bottom wall 30*a* of the case 30 (see FIG. 7).

As shown in FIGS. 1 and 2, an upper wall 30*b* of the case 30 of the photosensitive member cartridge 3 covers an upper portion of the photosensitive drum 13. The light entrance portion 31, allowing irradiation of an upper surface of the photosensitive drum 13 with laser light emitted from the laser scanner unit 7, is formed in the upper wall 30*b*, and is elongated in an axial direction of the photosensitive drum 13. A charger 36, such as a scorotron charger or the like, which charges a photosensitive surface of the photosensitive drum 13 formed of an organic photosensitive material or the like, is disposed close to the light entrance portion 31. The electrostatic latent image is formed on the surface of the photosensitive drum 13 by scanning the surface uniformly charged by the charger 36 with laser light. After the electrostatic latent image is made visible (developed) by deposition thereon of a thin layer of the toner supplied through the developing roller 22, the toner image is transferred to the sheet P in a press-transfer region defined by the photosensitive drum 13 and the transfer roller 14.

As shown in FIG. 2, a portion of the case 30 other than the upper wall 30*b* is opened upward to define a housing portion 32 into which the developing cartridge 4 can be detachably set from the above. An upper end surface of each of right and left side walls 30*c* of the case 30 defines a downwardly arched guide groove 37 that guides a corresponding one of bearings 23*a* and 23*b* (see FIG. 8) relatively rotatably mounted on both end portions of a developing roller shaft 22*a* serving as a rotational shaft of the developing roller 22 while supporting the bearing slidably. The guide grooves 37 extend toward a shaft 13*a* of the photosensitive drum 13. Therefore, when the developing cartridge 4 is set in the photosensitive member cartridge 3, the developing roller 22 can be positioned to face the photosensitive drum 13 (see FIG. 7).

Figure 7:
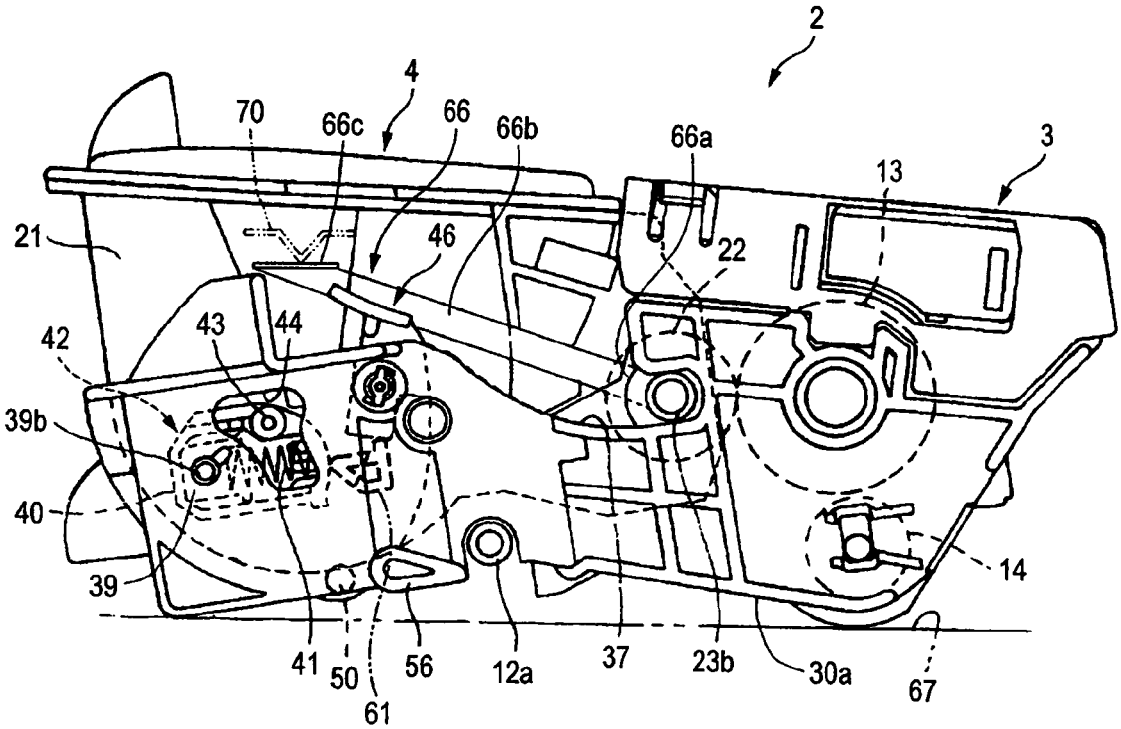
FIG. 7 is a right side view of the process cartridge.

An urging device 42 that presses the developing roller 22 against the photosensitive drum 13 through the developing cartridge 4 is pivotably and expandably mounted on an inner surface of each of the right and left side walls 30*c* of the photosensitive member cartridge 3. As shown in FIG. 7, each urging device 42 has a pivot fulcrum member 39 having pivots 39*b* (in FIG. 7, only a right pivot is shown) protruding integrally from the right and left sides thereof, a frame-like slide support member 40 that slidably supports the pivot fulcrum member 39 therein, and an urging spring member 41, such as a coil spring or the like, which is disposed in the frame of the slide support member 40 so as to urge the pivot fulcrum member 39 toward one end. The slide support member 40 has a cylindrical motion acting portion 43 extending laterally. The motion acting portion 43 of each urging device 42 is disposed so that the portion 43 protrudes outward from a guide hole 44 formed in the corresponding one of the right and left side walls 30*c*. When the developing cartridge 4 is mounted on the photosensitive member cartridge 3 and then is completely mounted on the main body housing 1 of the printer, the urging device 42 presses an action-receiving portion 61 described below of the developing cartridge 4 at a front end of the slide support member 40. Accordingly, with the urging device 42 and the action-receiving portion 61, the developing roller 22 can be pressed against the photosensitive drum 13 through the developing cartridge 4.

A lock device 46 that prevents the developing cartridge 4 fitted into the accommodating portion 32 from moving upward out of the accommodating portion 32 is disposed on an inner side of one of the right and left side walls 30*c* (the right side wall in the aspect) of the photosensitive member cartridge 3 (see FIG. 7). When a lock lever 47 provided in the lock device 46 is pressed down, the developing cartridge 4 can be unlocked from the photosensitive member cartridge 3.

Rollers 50 are disposed, as a developing cartridge receiving member, at a plurality of positions (two positions in the aspect, that is, at right and left end portions) in the bottom wall 30*a* of the case 30 in the accommodating portion 32 of the photosensitive member cartridge 3 (see FIGS. 2 and 7). The rollers 50 protrude from the inner surface of the bottom wall 30*a*. When the developing cartridge 4 is inserted down into the accommodating portion 32, the rollers 50 receive a portion of the weight of the developing cartridge 4 on an opposite side of the developing roller shaft 22*a* of the developing roller 22 to the photosensitive drum 13. More specifically, the rollers 50 contact lower portions of a downward-convex curved surface of a toner containing chamber 24 (see FIG. 1) provided in the case 21 of the developing cartridge 4 so as to reduce rattling of the case 21 during the attaching and detaching operation.

The upper roller 12*a* of the pair of register rollers is mounted to the bottom wall 30*a* of the case 30 of the photosensitive member cartridge 3. The bottom wall 30*a* has a laterally elongated introduction hole 51 close to the upper roller 12*a* so as to introduce the sheet P from the pair of register rollers 12*a* and 12*b* into a transfer portion 52 between the photosensitive drum 13 and the transfer roller 14. The upper surface of the bottom wall 30*a* extending between the introduction hole 51 and the transfer portion 52 has many ribs 53 (see FIG. 2) extending in a direction from the introduction hole 51 to the transfer portion 52. The ribs 53 are provided so that the sheet P can be smoothly conveyed with a reduced contact resistance on the lower surface of the sheet P.

(3) Configuration of Developing Cartridge

Figure 3:
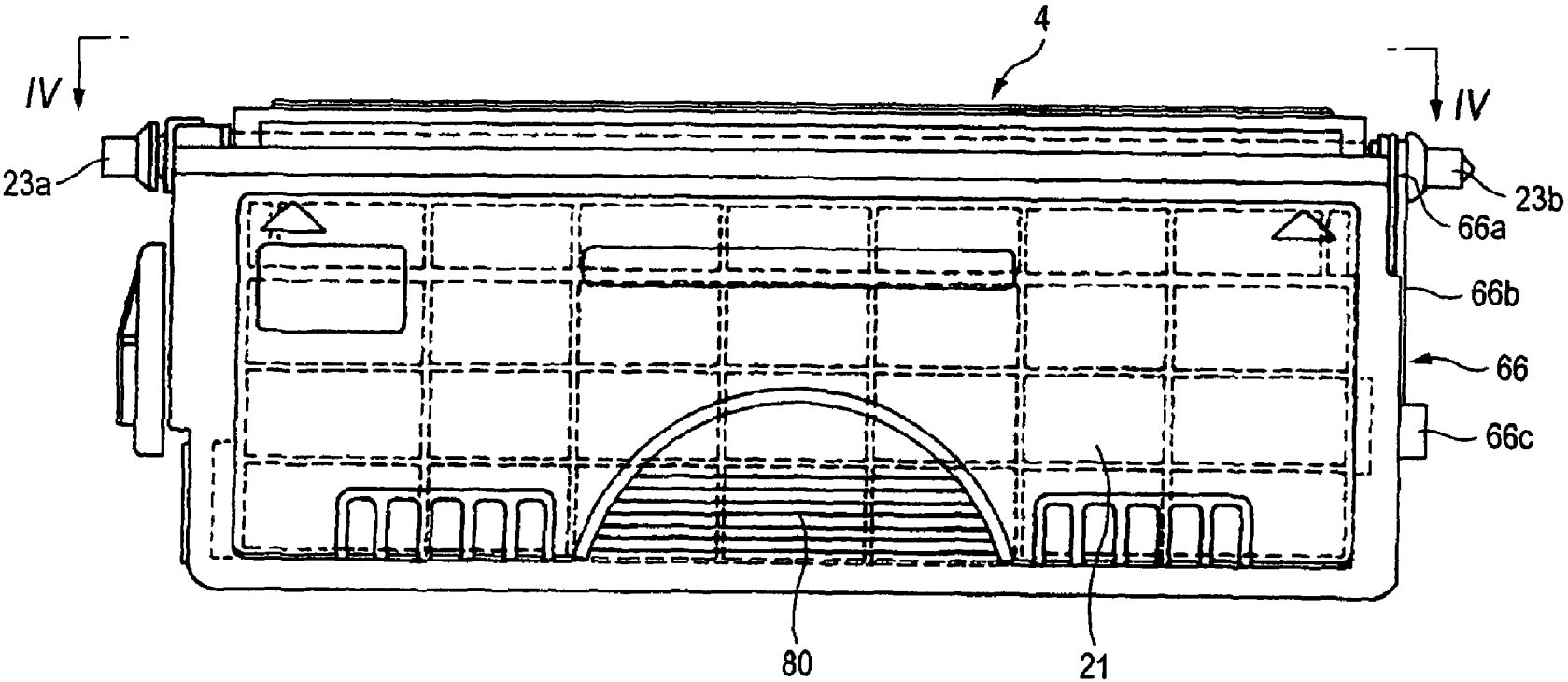
FIG. 3 is a plan view of a developing cartridge.
Figure 4:
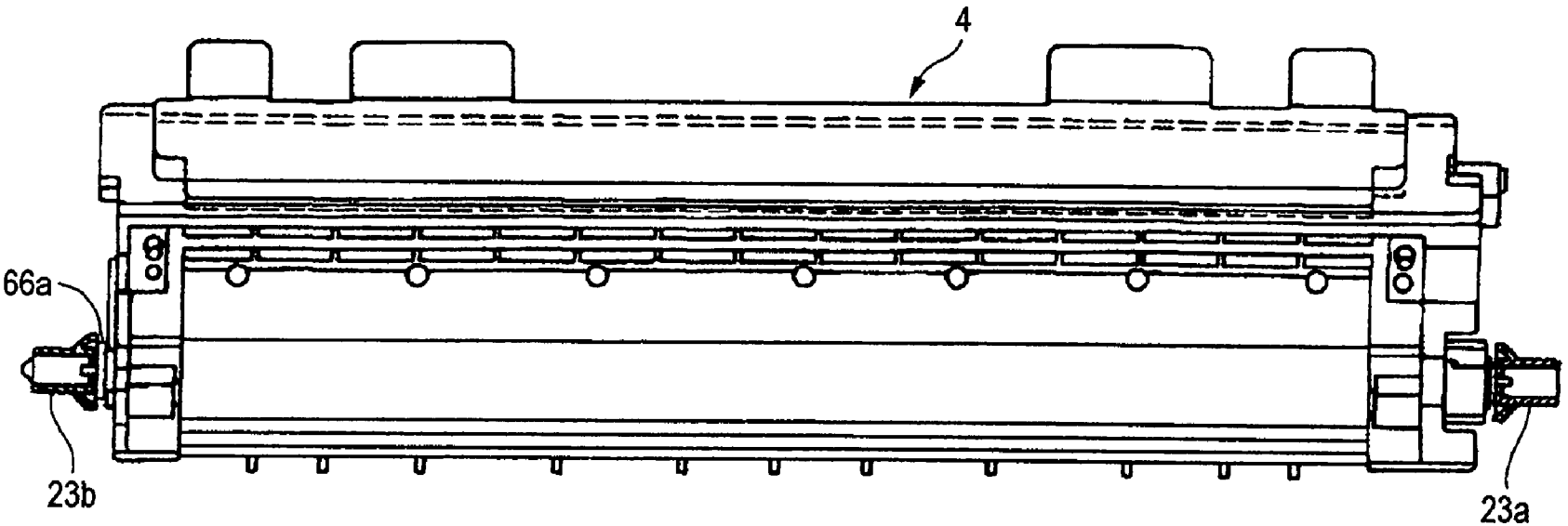
FIG. 4 is a cross-sectional view taken along the line IV-IV of FIG. 3.
Figure 5A:
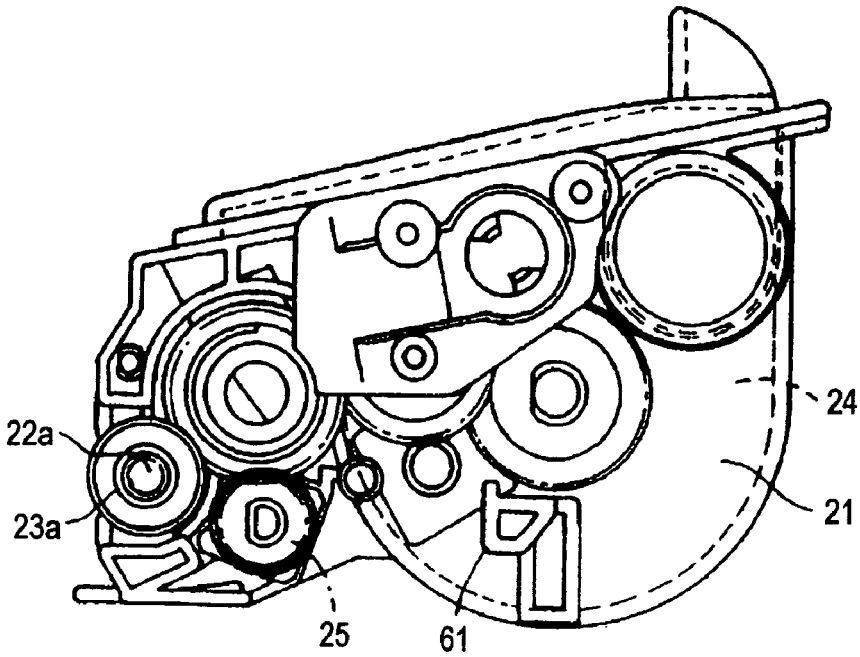
FIG. 5A is a left side view of the developing cartridge.
Figure 5B:
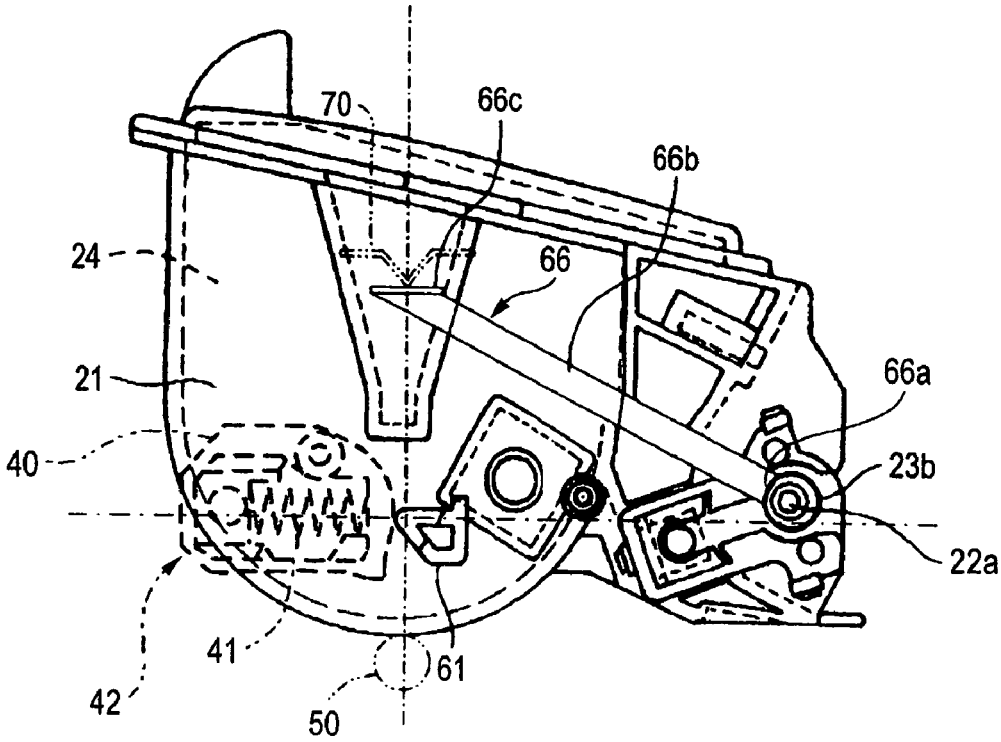
FIG. 5B is a right side view of the developing cartridge.

FIG. 3 is a plan view of the developing cartridge. FIG. 4 is a cross-sectional view taken along the line IV-IV of FIG. 3. FIG. 5A is a left side view of the developing cartridge, and FIG. 5B is a right side view of the developing cartridge. FIGS. 5A and 5B are shown at an angle when the developing cartridge 4 is mounted on the photosensitive member cartridge 3 and then mounted on the printer main body.

Next, the configuration of the developing cartridge 4 will be described with reference to FIGS. 1 and 3 to 5B. In the case 21 serving as a housing of the developing cartridge 4, an agitator 27 that agitates the toner in the toner containing chamber 24 is provided. The toner that is agitated by the agitator 27 and discharged is carried onto the outer peripheral surface of the developing roller 22, which is rotatably disposed in the developing cartridge 4, through a supply roller 25. At this time, the thickness of the toner is restricted by a blade 26 (see FIG. 1).

The action-receiving portions 61 are provided to integrally protrude from left and right outer sides of the toner containing chamber 24 in the case 21 of the developing cartridge 4. The action-receiving portion 61 has a triangular portion directed substantially horizontally. When the developing cartridge 4 is mounted on the photosensitive member cartridge 3 and then mounted on the main body housing 1 of the printer, the action-receiving portions 61 are urged by the urging device 42 described above. Accordingly, the developing roller 22 is pressed against the photosensitive drum 13 through the developing cartridge 4.

As shown in FIG. 3, grip portions 80 that facilitates handling, such as transportation or the like, are provided at upper and lower surfaces (in FIG. 3, only the upper surface is shown) of the case 21 of the developing cartridge 4.

Figure 8:
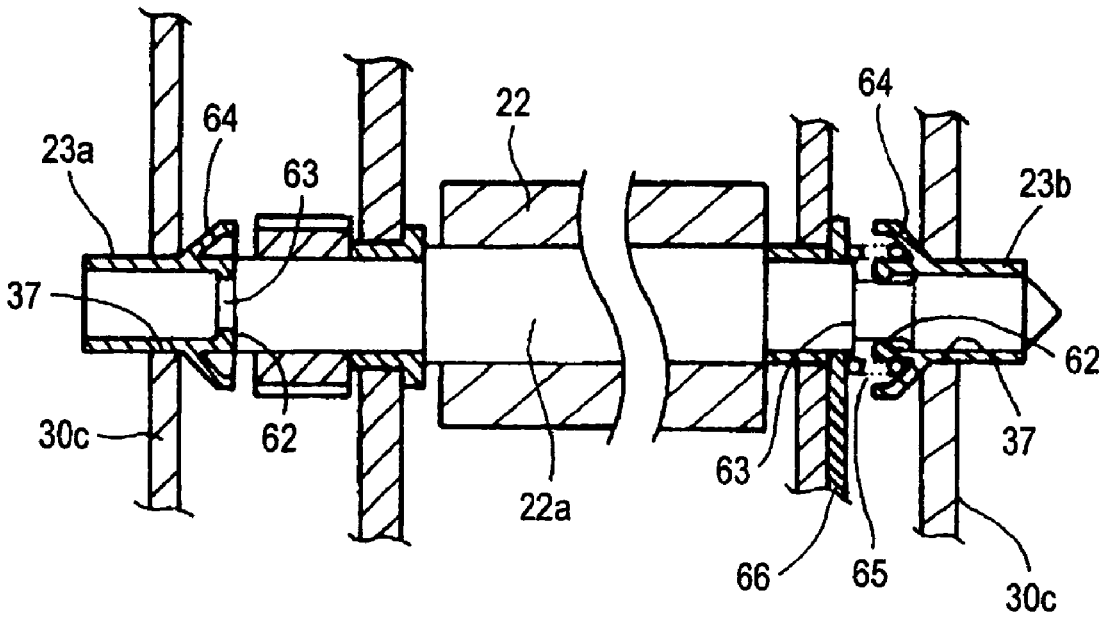
FIG. 8 is a cross-sectional view showing the structures of left and right bearings of a developing roller and a conductive member seen from an upper of FIG. 6.

FIG. 8 is a cross-sectional view showing structures of bearings on the left and right sides of the developing roller and the conductive member. As shown in FIG. 8, the developing roller 22 is a rubber roller that is formed by a substrate supported on the developing roller shaft 22*a* formed of a metal, such as stainless steel or the like. The rubber roller substrate has electrical conductivity by dispersing carbon black in silicon rubber or urethane rubber. The roller surface has a coating layer containing fluorine. The bearings 23*a* and 23*b* that are rotatably fitted to the developing roller shaft 22*a* at the left and right end portions of the developing roller shaft 22*a* are formed of a material whose frictional coefficient is small, such as acetal resin or the like. Each of the bearings 23*a* and 23*b* has an engaging claw 62 that is fitted into an annular groove 63 so as not to be detached from the shaft end of the developing roller shaft 22*a*.

Each of the bearings 23*a* and 23*b* has, at its base end side, an umbrella-shaped (conical) shaft diameter adjusting portion 64 whose diameter gradually increases. At least one of the bearings 23*a* and 23*b* (the right-side bearing 23*b* in this aspect) is slidingly urged laterally outward by a spring device 65. Accordingly, in a state where the developing cartridge 4 is set at a predetermined position of the photosensitive member cartridge 3, the developing roller shaft 22*a* of the developing roller 22 is supported, with no rattling, on the guide grooves 37 provided in the left and right side walls 30*c* of the photosensitive member cartridge 3. In this case, since both end portions of the developing roller shaft 22*a* serves as protrusions on both side ends of the developing cartridge 4 relative to the guide grooves 37, manufacturing costs can be reduced, and positioning or assembling accuracy can be improved. Further, since the developing roller shaft 22*a* that passes through the case 21 of the developing cartridge 4 is formed of a metal, strength can be increased, and thus breakage becomes unlikely.

The developing cartridge 4 has a conductive member 66 that is formed to be brought into contact with and electrically connected to the developing roller shaft 22*a*. As shown in FIGS. 3 and 5B, the conductive member 66 is a plate member formed of a metal. The conductive member 66 has one end portion 66*a* that is brought into contact with the developing roller shaft 22*a*, the other end portion 66*c* that is brought into contact with a main body-side power-supply electrode described below when the developing cartridge 4 is mounted on the printer main body, and an intermediate portion 66*b* that is formed between the one end portion 66*a* and the other end portion 66*c*. The shape of the conductive member 66 can be changed easily in accordance with an outer surface shape of the cartridge at low cost. Further, the conductive member 66 can be reliably brought into contact with the developing roller shaft 22*a* at the one end portion 66*a*, and can be reliably brought into contact with the main body-side power-supply electrode at the other end portion 66*c*. The conductive member 66 may be formed of conductive resin or the like, in addition to the plate member formed of a metal.

The conductive member 66 is formed such that the intermediate portion 66*b* follows the side wall of the case 21 of the developing cartridge 4 by a method of fixing using a two-sided tape or the like. The other end portion 66*c* is formed to have such a width that, when the developing cartridge 4 is mounted on the photosensitive member cartridge 3, it does not protrude outward from the case side wall 30*c* of the photosensitive member cartridge 3 (see FIG. 6). Therefore, when the developing cartridge 4 is mounted on the photosensitive member cartridge 3 or when the process cartridge 2 with the developing cartridge 4 mounted on the photosensitive member cartridge 3 is mounted on the printer main body, the conductive member 66 can be prevented from being deformed or broken due to interference with other members.

(4) Mounting of Developing Cartridge on Photosensitive Member Cartridge

Figure 6:
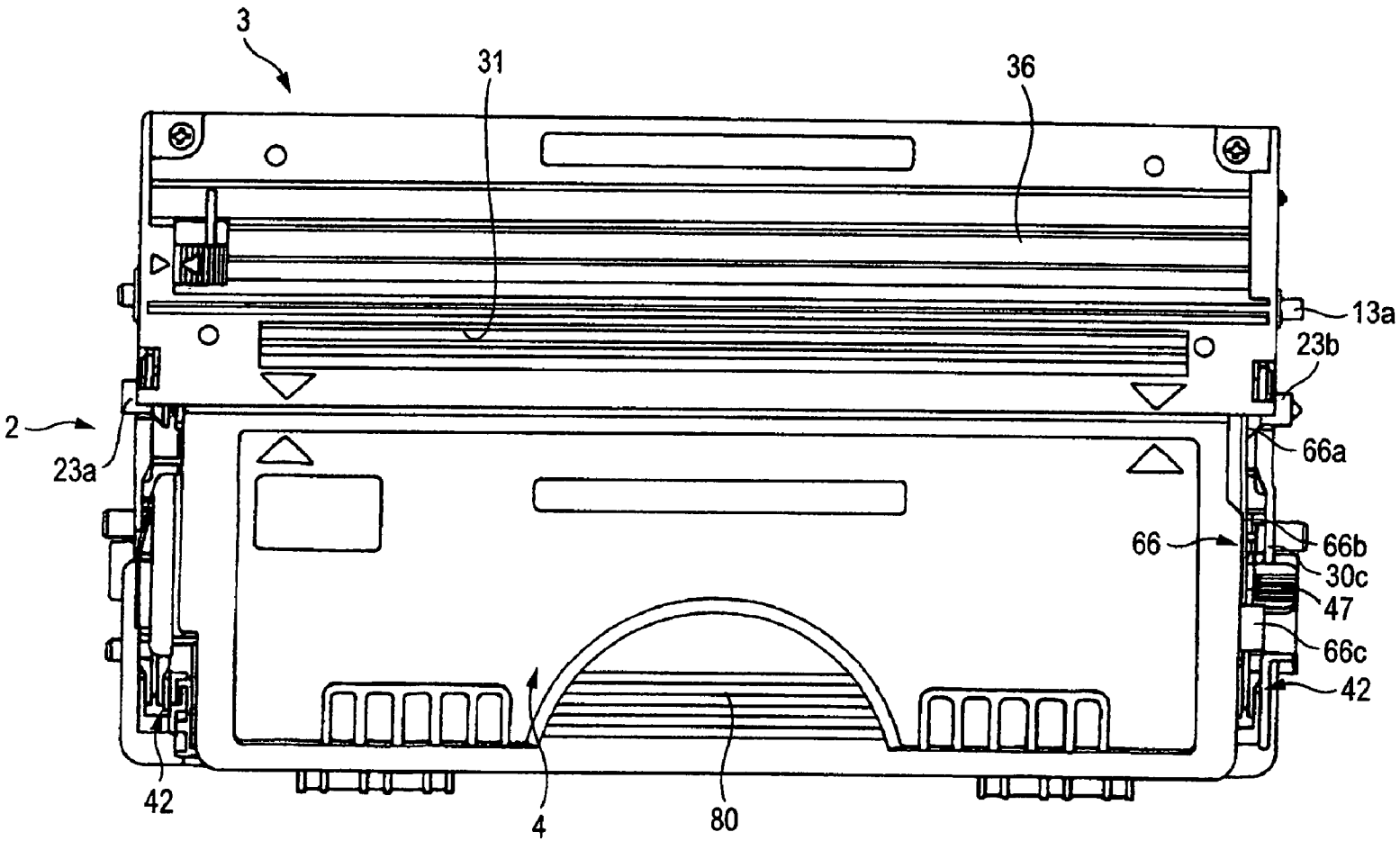
FIG. 6 is a plan view of a process cartridge.

The operation of setting the developing cartridge 4 on the photosensitive member cartridge 3 will be described with reference to FIGS. 2, 6, and 7. FIG. 6 is a plan view of the process cartridge 2 in a state where the developing cartridge 4 is set on the photosensitive member cartridge 3. FIG. 7 is a left side view when the process cartridge 2 is placed on a table 67.

The developing cartridge 4 is inserted into the upwardly open accommodating portion 32 provided in a rear portion of the case 30 of the photosensitive member cartridge 3 with the developing roller 22 side being a leading side, such that the developing cartridge 3 is mounted on the photosensitive member cartridge 3.

At this time, the bearings 23*a* and 23*b* disposed at the left and right side ends of the developing roller 22 slide down along the guide grooves 37 formed along the upper edges of the left and right side walls 30*c* of the case 30 of the photosensitive member cartridge 3 so as to approach the shaft 13*a* of the photosensitive drum 13. In this case, the case 21 of the developing cartridge 4 is pivotable about the bearings 23*a* and 23*b* of the developing roller shaft 22*a* of the developing roller 22. Therefore, when the bearings 23*a* and 23*b* come to positions on the guide grooves 37 close to the shaft 13*a* of the photosensitive drum 13 (laterally U-shaped portions), the toner containing chamber 24 of the case 21 of the developing cartridge 4 pivots about the shaft 22*a* of the developing roller 22. Then, the developing cartridge 4 is fittingly set in the accommodating portion 32 in the photosensitive member cartridge 3.

In this state, the rollers 50 in the accommodating portion 32 are slidingly brought into contact with a lower surface of the case 21 on the side of the toner containing chamber 24, and the bearings 23*a* and 23*b* move along the guide grooves 37 to such a position that the developing roller 22 is positioned substantially closest to the photosensitive drum 13. If mounting of the developing cartridge 4 on the photosensitive member cartridge 3 is completed, the developing cartridge 4 is locked by the lock device 46 such that the developing cartridge 4 is prevented from being removed from the photosensitive member cartridge 3.

At least one of the left and right bearings 23*a* and 23*b* is urged by the spring device 65 in such a direction of an axis that the conical jaw portion of the bearing is pressed toward an inner surface of the guide groove 37. In this manner, the bearings 23*a* and 23*b* are slid along the guide grooves 37. Therefore, even though there is a dimensional error between the distance between the bearings 23*a* and 23*b* and the distance between the guide grooves 37, rattling of the developing cartridge 4 laterally relative to the photosensitive member cartridge 3 (in the direction of the axis of the developing roller 22) does not occur. Further, since the bearings 23*a* and 23*b* are pivotable relative to the guide grooves 37, the bearings 23*a* and 23*b* of the developing cartridge 4 can be smoothly moved along the guide grooves 37, with no danger of being stopped on the grooves 37, when the developing cartridge 4 is to be set on the photosensitive member cartridge 3 or removed therefrom (see FIG. 8).

(5) Mounting of Process Cartridge on Printer Main Body

Referring to FIG. 1, in the process cartridge 2, in a state where a lid 1*b* at a right end (a front surface) of the main body housing 1 is downwardly turned to form a large opening, the shaft 13*a* of the photosensitive drum 13 and guiding members 56 (in FIG. 7, only one of the guiding members 56 is shown), which protrude laterally from lower ends of the left and right sides of the process cartridge 2 (the photosensitive member cartridge 3), are guided to guide surfaces formed at left and right inner surfaces of the main body housing 1 and then inserted into the main body housing 1. Then, if the process cartridge 2 is set at a predetermined position of the main body housing 1, an upper roller 12*a* on a lower surface side of the case 30 of the photosensitive member cartridge 3 is placed on a lower roller 12*b* disposed on the side of the main body housing 1 and is pressed by a spring (not shown). Further, the action-receiving portions 61 provided in the developing cartridge 4 at a leading end of the slide support member 40 of the urging device 42 provided in the photosensitive member cartridge 3. Accordingly, the developing roller 22 can be pressed against the photosensitive drum 13 through the developing cartridge 4.

In a state where the process cartridge 2 with the developing cartridge 4 mounted thereon is mounted at a predetermined position of the main body housing 1 of the printer, the main body-side power supply electrode 70 (indicated by the virtual line in FIGS. 5 and 7) that is provided in the main body housing 1 is elastically brought into contact with the upper surface of the other end portion 66*c* of the conductive member 66 toward to the rollers 50.

The main body-side power-supply electrode 70 is connected to a high-pressure substrate (not shown) that is provided in the main body housing 1, and the developing bias is applied from the high-pressure substrate. For this reason, if the main body-side power supply electrode 70 is elastically brought into contact with the upper surface of the other end portion 66*c* of the conductive member 66, the developing bias that is applied from the high-pressure substrate is applied from the main body-side power-supply electrode 70 to the developing shaft roller 22*a* through the conductive member 66 and then applied from the developing roller shaft 22*a* to the conductive rubber roller.

As shown in FIG. 5, the other end portion 66*c* of the conductive member 66 is brought into contact with the main body-side power-supply electrode 70 on a vertical line of the rollers 50 serving as a developing cartridge receiving portion provided at the bottom wall 30*a* of the case 30 of the photosensitive member cartridge 3. When the developing cartridge 4 is inserted down into the accommodating portion 32 of the photosensitive member cartridge 3, the rollers 50 are designed to receive a portion of the weight of the developing cartridge 4 on a side across the developing roller shaft 22*a* of the developing roller 22 opposite to the photosensitive drum 13 and to reduce rattling of the case 21 of the developing cartridge 4 during the setting or removing operation. Accordingly, the developing cartridge 4 is stably mounted on the photosensitive member cartridge 3 in a state where the center of gravity thereof is applied to the rollers 50. Since the main body-side power-supply electrode 70 is brought into contact with the other end portion 66*c* of the conductive member 66 on the vertical line of the rubbers 50, rattling of the developing cartridge 4 relative to the photosensitive member cartridge 3 by the contact of the main body-side power-supply electrode 70 does not occur. Therefore, pressing of the developing roller 22 against the photosensitive drum 13 can be prevented from being instable, and thus good image quality can be secured.

The urging device 42 presses the action-receiving portion 61 substantially horizontally. Thus, the pressing direction is substantially perpendicular to a direction in which the conductive member 66 is brought into contact with the main body-side power-supply electrode 70. Accordingly, even when the developing cartridge 4 moves due to the pressing force of the urging device 42, a distance between the conductive member 66 and the main body-side power-supply electrode 70 is kept substantially constant. Thus, the contact condition between the conductive member 66 and the main body-side power-supply electrode 70 is not degraded.

(6) Modification

Figure 9:
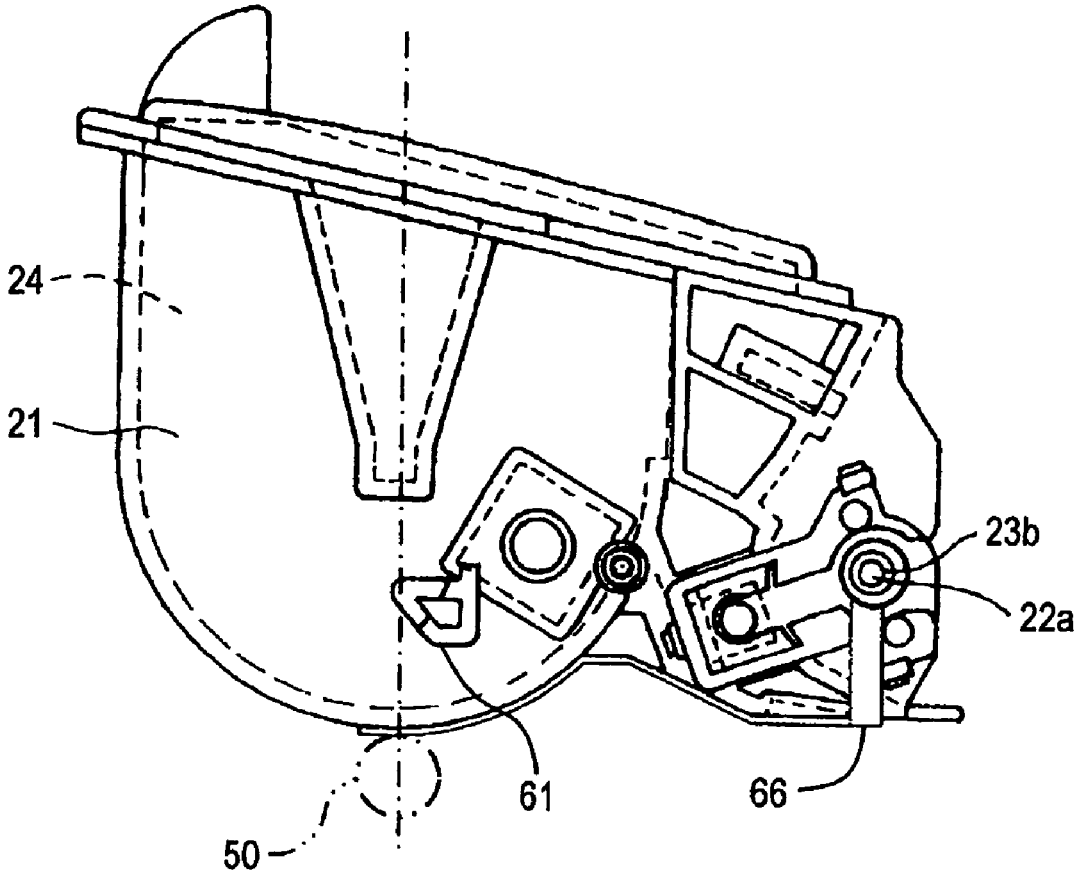
FIG. 9 is a diagram showing a modification of this aspect.

FIG. 9 is a diagram showing a modification of this aspect. A difference between this modification and the above-described aspect is that a separate main body-side power-supply electrode 70 is not formed, and the rollers 50 serving as the developing cartridge receiving portion also serve as a power-supply electrode for applying the developing bias to the developing roller 22. That is, the rollers 50 are formed as a conductive electrode and are connected to a high-pressure substrate (not shown) that is provided in the main body housing 1, such that the developing bias is applied from the high-pressure substrate.

The conductive member 66 that is formed to be electrically connected to the developing roller shaft 22*a* extends onto the vertical line of the rollers 50 at the lower surface of the toner containing chamber 24 along the case 21 of the developing cartridge 4 and is brought into contact with the rollers 50 at that position. Accordingly, the developing bias is applied to the developing roller 22. The rollers 50 may be provided in the photosensitive member cartridge 3 or may be provided in the printer main body.

With the configuration according to the modification, since the rollers 50 are brought into contact with the conductive member 66 at a position where rattling relative to the developing cartridge 4 does not occur, the contact state of the photosensitive drum 13 and the developing roller 22 can be prevented from being instable, and thus good image quality can be secured.

In the above description, the developing cartridge 4 is mounted on the photosensitive member cartridge 3 in advance, and then the process cartridge 2 is attached to and detached from the main body housing 1. Alternatively, the photosensitive member cartridge 3 and the developing cartridge 4 may be separately attachable to and detachable from the main body housing 1. In this case, the guide grooves 37 that slidably guide and support the bearings 23*a* and 23*b*, protruding from both outer surfaces of the developing cartridge 4, formed at both ends of the developing roller shaft 22*a* are formed at the left and right sides of the main body housing 1.

What is claimed is:

1. A process cartridge for use with an image forming apparatus including a main-body side power supply electrode, the process cartridge comprising:

an electrostatic latent image carrier;

a housing that rotatably supports the electrostatic latent image carrier, the housing comprising:

rollers; and a slide support member; and a developing cartridge, which is attachable to and detachable from the housing of the process cartridge, the developing cartridge being supported by the rollers, the developing cartridge comprising:

a developer carrier comprising a rotational shaft;

an action receiving member;

a case that rotatably supports the developer carrier, the case comprising a toner containing chamber; and a conductive member, one end of the conductive member being electrically connected to the rotational shaft of the developer carrier, and another end of the conductive member being positioned above the rollers and positioned at a center of the toner containing chamber, the conductive member passing an outer surface of the toner containing chamber;

wherein the main-body side power supply electrode presses another end of the conductive member in a first direction;

wherein the slide support member presses the action receiving member in a second direction; and wherein the first direction and the second direction extend substantially perpendicular to one another in a plane that is perpendicular to the rotational shaft of the developer carrier.

2. The process cartridge according to claim 1, wherein the conductive member further comprises an intermediate portion that is positioned between the one end and the another end of the conductive member and the another end is positioned to be brought into contact with a main body-side power-supply electrode of an image forming apparatus.

3. The process cartridge according to claim 2, wherein the intermediate portion is formed along the case of the developing cartridge.

4. The process cartridge according to claim 1, wherein the conductive member is formed of a metal plate member.

5. The process cartridge according to claim 1, further comprising an urging device that urges substantially horizontally a protrusion protruded a predetermined length from the case of the developing cartridge.

6. A process cartridge for use with an image forming apparatus including a main-body side power supply electrode, the process cartridge comprising:

an electrostatic latent image carrier;

a housing that rotatably supports the electrostatic latent image carrier, the housing comprising:

rollers; and a slide support member; and a developing cartridge, which is attachable to and detachable from the housing of the process cartridge, the developing cartridge being supported by the rollers, the developing cartridge comprising:

a developer carrier comprising a rotational shaft;

an action receiving member;

a case that rotatably supports the developer carrier, the case comprising a toner containing chamber; and a conductive member, one end of the conductive member being directly attached to the rotational shaft of the developer carrier and another end of the conductive member being positioned above the rollers and positioned at a center of the toner containing chamber, the conductive member passing an outer surface of the toner containing chamber;

wherein the main-body side power supply electrode presses the one end of the conductive member in a first direction;

wherein the slide support member presses the action receiving member in a second direction; and wherein the first direction and the second direction extend substantially perpendicular to one another in a plane that is perpendicular to the rotational shaft of the developer carrier.

7. The process cartridge according to claim 6, wherein the conductive member is formed of a metal plate member.

8. The process cartridge according to claim 6, further comprising an urging device that urges substantially horizontally a protrusion protruded a predetermined length from the case of the developing cartridge.

9. An image forming apparatus comprising:

a power supply electrode; and a process cartridge comprising:

an electrostatic latent image carrier;

a housing that rotatably supports the electrostatic latent image carrier, the housing comprising:

rollers; and a slide support member; and a developing cartridge, the developing cartridge being attachable to and detachable from the housing, the developing cartridge being supported by the rollers, and the developing cartridge comprising:

a developer carrier comprising a rotational shaft;

an action receiving member;

a case that rotatably supports the developer carrier, the case comprising a toner containing chamber; and a conductive member, one end of the conductive member being electrically connected to the rotational shaft of the developer carrier and another end of the conductive member being positioned between the power supply electrode and rollers and positioned at a center of the toner containing chamber when the developing cartridge is attached to the, the conductive member passing an outer surface of the toner containing chamber;

wherein the main-body side power supply electrode presses the one end of the conductive member in a first direction;

wherein the slide support member presses the action receiving member in a second direction; and wherein the first direction and the second direction extend substantially perpendicular to one another in a plane that is perpendicular to the rotational shaft of the developer carrier.

10. The image forming apparatus according to claim 9, wherein the conductive member further comprises an intermediate portion that is positioned between the one end and the another end of the conductive member, and the another end of the conductive member is positioned to be brought into contact with the power supply electrode.

11. The image forming apparatus according to claim 10, wherein the intermediate portion is formed along the case of the developing cartridge.

12. The image forming apparatus according to claim 9, wherein the conductive member is formed of a metal plate member.

13. The image forming apparatus according to claim 9, further comprising an urging device that urges substantially horizontally a protrusion protruded a predetermined length from the case of the developing cartridge.

14. An image forming apparatus comprising:

a power supply electrode; and a process cartridge comprising:

an electrostatic latent image carrier;

a housing that rotatably supports the electrostatic latent image carrier, the housing comprising:

rollers; and a slide support member; and a developing cartridge, the developing cartridge being attachable to and detachable from the housing, the developing cartridge being supported by the rollers, and the developing cartridge comprising:

a developer carrier comprising a rotational shaft;

an action receiving member;

a case that rotatably supports the developer carrier, the case being supported by the rollers and comprising a toner containing chamber; and a conductive member, one end of the conductive member being electrically connected to the rotational shaft of the developer carrier and another end of the conductive member being positioned between the power supply electrode and the rollers and positioned at a center of the toner containing chamber when the developing cartridge is attached to the image forming apparatus, the conductive member passing an outer surface of the toner containing chamber;

wherein the main-body side power supply electrode presses the one end of the conductive member in a first direction;

wherein the slide support member presses the action receiving member in a second direction; and wherein the first direction and the second direction extend substantially perpendicular to one another in a plane that is perpendicular to the rotational shaft of the developer carrier.

15. The image forming apparatus according to claim 14, wherein the conductive member is formed of a metal plate member.

16. The image forming apparatus according to claim 14, further comprising an urging device that urges substantially horizontally a protrusion protruded a predetermined length from the case of the developing cartridge.

17. An image forming apparatus comprising:

a developing cartridge comprising a developer carrier comprising a rotational shaft, a toner containing chamber, an action receiving member, and a conductive member having one end attached to the rotational shaft, and another end of the conductive member being positioned at a center of the toner containing chamber, the conductive member passing an outer surface of the toner containing chamber;

a photosensitive member cartridge comprising an electrostatic latent image carrier, and a housing rotatably supporting the electrostatic latent image carrier, the housing comprising:

a slide support member; and a plurality of rollers that are positioned such that the rollers receive the developing cartridge and bear a portion of the weight of the developing cartridge; and a power-supply electrode that is attached to a body of the image forming apparatus such that an end portion of the conductive member is positioned between the power-supply electrode and the rollers;

wherein the power supply electrode presses the one end of the conductive member in a first direction;

wherein the slide support member presses the action receiving member in a second direction; and wherein the first direction and the second direction extend substantially perpendicular to one another in a plane that is perpendicular to the rotational shaft of the developer carrier.

* * * * *